US011532257B2

(12) United States Patent
Koizumi et al.

(10) Patent No.: US 11,532,257 B2
(45) Date of Patent: Dec. 20, 2022

(54) DISPLAY DRIVER AND DISPLAY DEVICE

(71) Applicant: LAPIS Technology Co., Ltd., Yokohama (JP)

(72) Inventors: Hayato Koizumi, Yokohama (JP); Hiroshi Tsuchi, Yokohama (JP)

(73) Assignee: LAPIS Technology Co., Ltd., Yokohama (JP)

( * ) Notice: Subject to any disclaimer, the term of this patent is extended or adjusted under 35 U.S.C. 154(b) by 0 days.

(21) Appl. No.: 17/515,553

(22) Filed: Nov. 1, 2021

(65) Prior Publication Data

US 2022/0139285 A1 May 5, 2022

(30) Foreign Application Priority Data

Nov. 2, 2020 (JP) ..... JP2020-183615

(51) Int. Cl.
*G09G 5/10* (2006.01)
*G09G 3/20* (2006.01)

(52) U.S. Cl.
CPC ..... *G09G 3/20* (2013.01); *G09G 2310/08* (2013.01); *G09G 2320/041* (2013.01); *G09G 2330/045* (2013.01)

(58) Field of Classification Search
CPC ..... G09G 3/20; G09G 2310/08; G09G 2320/041; G09G 2330/045; G09G 2320/0613; G09G 2320/0626; G09G 2320/04; G09G 2330/04
See application file for complete search history.

(56) References Cited

FOREIGN PATENT DOCUMENTS

| | | | | |
|---|---|---|---|---|
| JP | 2011112970 | | 6/2011 | |
| WO | WO-2014096944 | A1 * | 6/2014 | ..... G09G 3/20 |
| WO | WO-2015002258 | A1 * | 1/2015 | ..... B60K 35/00 |

* cited by examiner

*Primary Examiner* — Adam R. Giesy
(74) *Attorney, Agent, or Firm* — JCIPRNET

(57) ABSTRACT

The disclosure provides a display driver and a display device which includes the display driver. A display driver according to the disclosure has a temperature abnormality detection circuit that detects a temperature inside the display driver and generates a temperature abnormality detection signal indicating the presence of a temperature abnormality when the temperature therein is higher than a predetermined temperature threshold, and a temperature abnormality notification processing part that causes a display panel to display an image for informing of occurrence of a temperature abnormality for a predetermined period instead of an image based on a video signal in accordance with the temperature abnormality detection signal.

14 Claims, 11 Drawing Sheets

DISPLAY DRIVER AND DISPLAY DEVICE

CROSS-REFERENCE TO RELATED APPLICATION

This application claims priority under 35 USC 119 from Japanese Patent application No. 2020-183615 filed on Nov. 2, 2020, the disclosure of which is incorporated by reference herein.

BACKGROUND

Technical Field

The disclosure relates to a display source driver for driving a display panel in accordance with a video signal, and a display device including the display source driver.

Description of Related Art

A display source driver is provided with a plurality of output buffers generating a plurality of driving voltages based on a video signal and individually outputting the generated driving voltages to a plurality of data lines of a display panel.

Inside each of the output buffers, heat is generated when a current for generating a driving voltage passes through an internal resistance of itself. However, the internal temperature of source drivers has become higher due to the increase in the number of output buffers and high-speed operation accompanying increase in definition and frame rate of display panels in recent years. Meanwhile, due to the increase in temperature of a source driver, there is concern that the source driver may be brought into an operation failure state and deterioration in image quality may be caused.

Hence, a source driver provided with a temperature abnormality avoidance transmission circuit for switching over to a display operation avoiding the temperature abnormality in a case of detecting a temperature abnormality in which a temperature of a source driver rises to an extent that an operation failure is caused has been proposed (for example, refer to Patent Document 1 (Japanese Patent Application Laid-Open No. 2011-112970)). In the source driver described in Patent Document 1, in a case of detecting such a temperature abnormality, a heat-generation temperature of the source driver is reduced by causing an amplitude of a driving voltage generated by each output buffer to be smaller than that during a normal time.

Incidentally, for example, during product shipment of the foregoing source drivers and display panels assembled in a factory, there is a need to test whether or not a display operation for avoiding a temperature abnormality has been correctly performed.

In addition, in a development stage of a source driver, it is conceivable to execute a temperature evaluation test for evaluating a limit temperature at which a normal operation can be performed in a state in which the source driver is connected to a display panel.

For example, in a temperature evaluation test, when a temperature abnormality is detected after a video signal indicating a test display pattern is supplied to a source driver while details of the display pattern are varied, the display pattern used at the time of detection is identified as a limit display pattern in which a temperature abnormality occurs.

Incidentally, in order to perform such a test with the source driver described in Patent Document 1, a probe of a tester is connected to a dedicated terminal provided in the source driver, namely a terminal for outputting a signal indicating whether or not the temperature has become equal to or higher than a set temperature. Further, an evaluator checks the time when a temperature abnormality has occurred by monitoring signals from the foregoing probe using the tester while supplying a video signal indicating a test display pattern to the source driver.

However, in order to perform such a test with the source driver described in Patent Document 1, as described above, the test entails troublesome work of manually connecting the probe of the tester to the dedicated terminal of the source driver. In addition, depending on the dedicated terminal of the source driver, it may be difficult to perform such connection of the probe.

The disclosure provides a source driver in which a temperature evaluation test can be easily performed with respect to a source driver connected to a display panel, and a display device which includes the source driver.

SUMMARY

A source driver according to the disclosure is a source driver that performs driving for causing a display panel to display an image based on a video signal. The source driver has a temperature abnormality detection circuit that detects a temperature inside the source driver and generates a temperature abnormality detection signal indicating the presence of a temperature abnormality when the temperature is higher than a predetermined temperature threshold, and a temperature abnormality notification processing part that causes the display panel to display an image for informing of occurrence of a temperature abnormality for a predetermined period instead of an image based on the video signal in accordance with the temperature abnormality detection signal.

In addition, a source driver according to the disclosure is a source driver that performs driving for causing a display panel to display an image based on a video signal. The source driver has a temperature abnormality detection circuit that detects a temperature inside the source driver and generates a temperature abnormality detection signal indicating the presence of a temperature abnormality when the temperature is higher than a predetermined temperature threshold, and a temperature abnormality notification processing part that changes a display form of a partial region in an image based on the video signal in accordance with the temperature abnormality detection signal.

A display device according to the disclosure includes a display panel, and a source driver that receives a video signal and performs driving for causing the display panel to display an image based on the video signal. The source driver has a temperature abnormality detection circuit that detects a temperature inside the source driver and generates a temperature abnormality detection signal indicating the presence of a temperature abnormality when the temperature is higher than a predetermined temperature threshold, and a temperature abnormality notification processing part that causes the display panel to display an image for informing of occurrence of a temperature abnormality for a predetermined period instead of an image based on the video signal in accordance with the temperature abnormality detection signal.

DESCRIPTION OF THE EMBODIMENTS

Hereinafter, Examples of the disclosure will be described in detail with reference to the drawings.

Example 1

Figure 1:
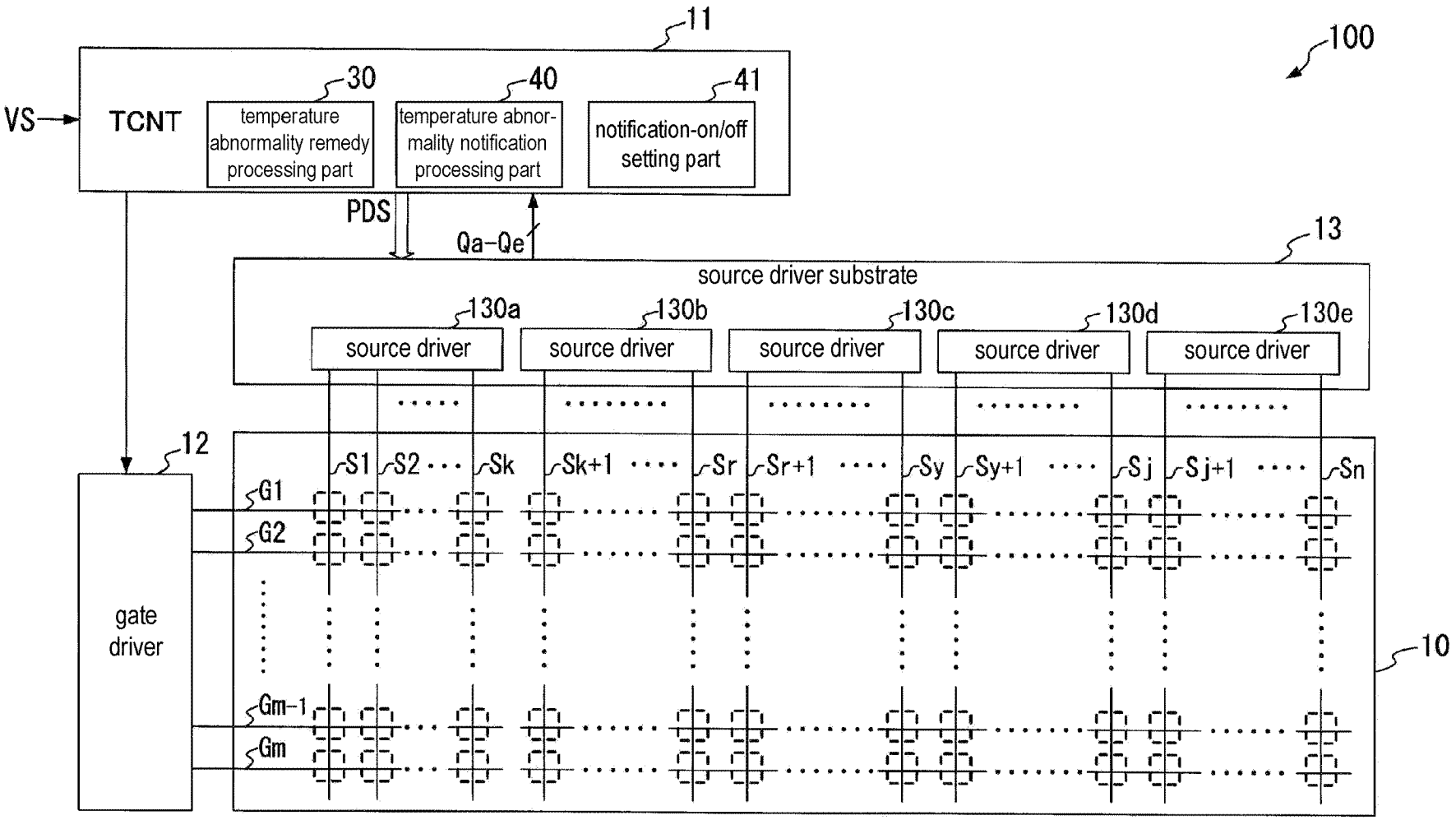
FIG. 1 is a view showing an example of a schematic constitution of a display device 100 including a source driver according to the disclosure.

FIG. 1 is a view illustrating an example of a schematic constitution of a display device 100 including a display source driver according to the disclosure. As illustrated in FIG. 1, the display device 100 includes a TCNT 11 serving as a timing control unit, a gate driver 12, a source driver substrate 13 having a plurality of source drivers (130*a* to 130*e*), and a display panel 10.

For example, the display panel 10 is constituted of an image display panel such as a liquid crystal panel or an organic EL panel. In the display panel 10, m (m is an integer of 2 or larger) gate lines G1 to Gm serving as horizontal scanning lines which individually extend in a horizontal direction on a two-dimensional screen and n (n is an integer of 2 or larger) source lines S1 to Sn which individually extend in a vertical direction on the two-dimensional screen are arranged. A display cell serving as a pixel is formed at each of intersection parts of the gate lines and the source lines.

The TCNT 11 is formed in a semiconductor integrated circuit (IC) chip. The TCNT 11 receives a video signal VS and generates a series of pieces of pixel data PD individually indicating a luminance level of each pixel in 8-bit data, for example, on the basis of the video signal VS. In addition, the TCNT 11 generates a reference timing signal which becomes a reference for a clock signal and a load signal which indicates a timing for starting to import the pixel data. Moreover, the TCNT 11 generates a temperature detection command prompting execution of a temperature detection process for each vertical blanking period in the video signal VS. Further, as an image data signal PDS, the TCNT 11 supplies a signal, which is realized by applying the reference timing signal, the load signal, and the temperature detection command described above to the generated series of pieces of pixel data PD, to each of the plurality of source drivers (130*a* to 130*e*) via the source driver substrate 13.

The TCNT 11 executes temperature monitoring control (which will be described below) on the basis of temperature abnormality detection signals Qa to Qe output from each of the plurality of source drivers (130*a* to 130*e*) when it is determined that a temperature abnormality has occurred in any of the plurality of source drivers.

Moreover, the TCNT 11 extracts a horizontal synchronization signal from the video signal VS and supplies this to the gate driver 12.

The gate driver 12 generates a gate pulse synchronously with a horizontal synchronization signal supplied from the TCNT 11 and sequentially applies this to each of the gate lines G1 to Gm of the display panel 10.

The source driver substrate 13 has five source drivers 130*a* to 130*e*, for example, individually constituted of an independent semiconductor integrated circuit (IC) chip. The source driver 130*a* is used for driving the source lines S1 to Sk (k is an integer of 2 or larger) of the source lines S1 to Sn of the display panel 10. The source driver 130*b* is used for driving the source lines Sk+1 to Sr (r is an integer of 2 or larger). The source driver 130*c* is used for driving the source lines Sr+1 to Sy (y is an integer of 2 or larger). The source driver 130*d* is used for driving the source lines Sy+1 to Sj (j is an integer of 2 or larger). The source driver 130*e* is used for driving the source lines Sj+1 to Sn. The same circuit is formed in each of the source drivers 130*a* to 130*e*. The source driver substrate 13 individually supplies an image data signal corresponding to the source lines individually used for driving from the image data signal PDS to each of the source drivers or supplies the temperature abnormality detection signals Qa to Qe output from each of the source drivers to the TCNT 11.

Each of the source drivers 130*a* to 130*e* receives the image data signal PDS and imports the series of pieces of pixel data PD corresponding to itself from the image data signal PDS in accordance with the load signal included in the image data signal PDS. Further, each of the source drivers 130*a* to 130*e* converts each piece of the imported pixel data PD into a driving voltage having a voltage value corresponding to the luminance level indicated by each of the source drivers 130*a* to 130*e* and applies the converted driving voltage to the source lines corresponding to each of the source drivers 130*a* to 130*e*.

For example, the source driver 130*a* imports k pieces of pixel data PD corresponding to the first row to the kth row of the display panel 10 from the image data signal PDS. Further, the source driver 130*a* generates k driving voltages X1 to Xk corresponding to the luminance level indicated by each of the k pieces of pixel data PD and applies each of the k driving voltages X1 to Xk to the source lines S1 to Sk of the display panel 10. The source driver 130*b* imports (r−k) pieces of pixel data PD corresponding to the k+1th row to the rth row of the display panel 10 from the image data signal PDS. Further, the source driver 130*b* generates the driving voltages Xk+1 to Xr corresponding to the luminance level indicated by each of the (r−k) pieces of pixel data PD and applies each of the driving voltages Xk+1 to Xr to the source lines Sk+1 to Sr of the display panel 10. The source driver 130*c* imports (y−r) pieces of pixel data PD corresponding to the r+1th row to the yth row of the display panel 10 from the image data signal PDS. Further, the source driver 130*c* generates the driving voltages Xr+1 to Xy corresponding to the luminance level indicated by each of the (y−r) pieces of pixel data PD and applies each of the driving voltages Xr+1 to Xy to the source lines Sr+1 to Sy of the display panel 10. The source driver 130*d* imports (j−y) pieces of pixel data PD corresponding to the y+1th row to the jth row of the display panel 10 from the image data signal PDS. Further, the source driver 130*d* generates the driving voltage Xy+1 to Xj corresponding to the luminance level indicated by each of the (j−y) pieces of pixel data PD and applies each of the driving voltage Xy+1 to Xj to the source lines Sy+1 to Sj of the display panel 10. The source driver 130*e* imports (n−j) pieces of pixel data PD corresponding to the j+1th row to the nth row of the display panel 10 from the image data signal PDS. Further, the source driver 130*e* generates the driving voltage Xj+1 to Xn corresponding to the luminance level indicated by each of the (n−j) pieces of pixel data PD and applies each of the driving voltage Xj+1 to Xn to the source lines Sj+1 to Sn of the display panel 10.

Moreover, each of the source drivers 130*a* to 130*e* generates a temperature abnormality detection signal indicating "presence of a temperature abnormality" when the internal temperature thereof is higher than a predetermined temperature threshold and indicating "no temperature abnormality" when the internal temperature thereof is equal to or lower than the temperature threshold. At this time, the source driver 130*a* supplies the generated temperature abnormality detection signal to the TCNT 11 as a temperature abnormality detection signal Qa. The source driver 130*b* supplies the generated temperature abnormality detection signal to the TCNT 11 as a temperature abnormality detection signal Qb. The source driver 130*c* supplies the generated temperature abnormality detection signal to the TCNT 11 as a temperature abnormality detection signal Qc. The source driver 130*d* supplies the generated temperature abnormality detection signal to the TCNT 11 as a temperature abnormality detection signal Qd. The source driver 130*e* supplies the generated temperature abnormality detection signal to the TCNT 11 as a temperature abnormality detection signal Qe.

Hereinafter, an internal constitution of each of the source drivers 130*a* to 130*e* will be described.

The circuits respectively formed in the source drivers 130*a* to 130*e* are the same as each other. Hereinafter, the source driver 130*a* is selected for describing the circuit formed in each of the drivers.

Figure 2:
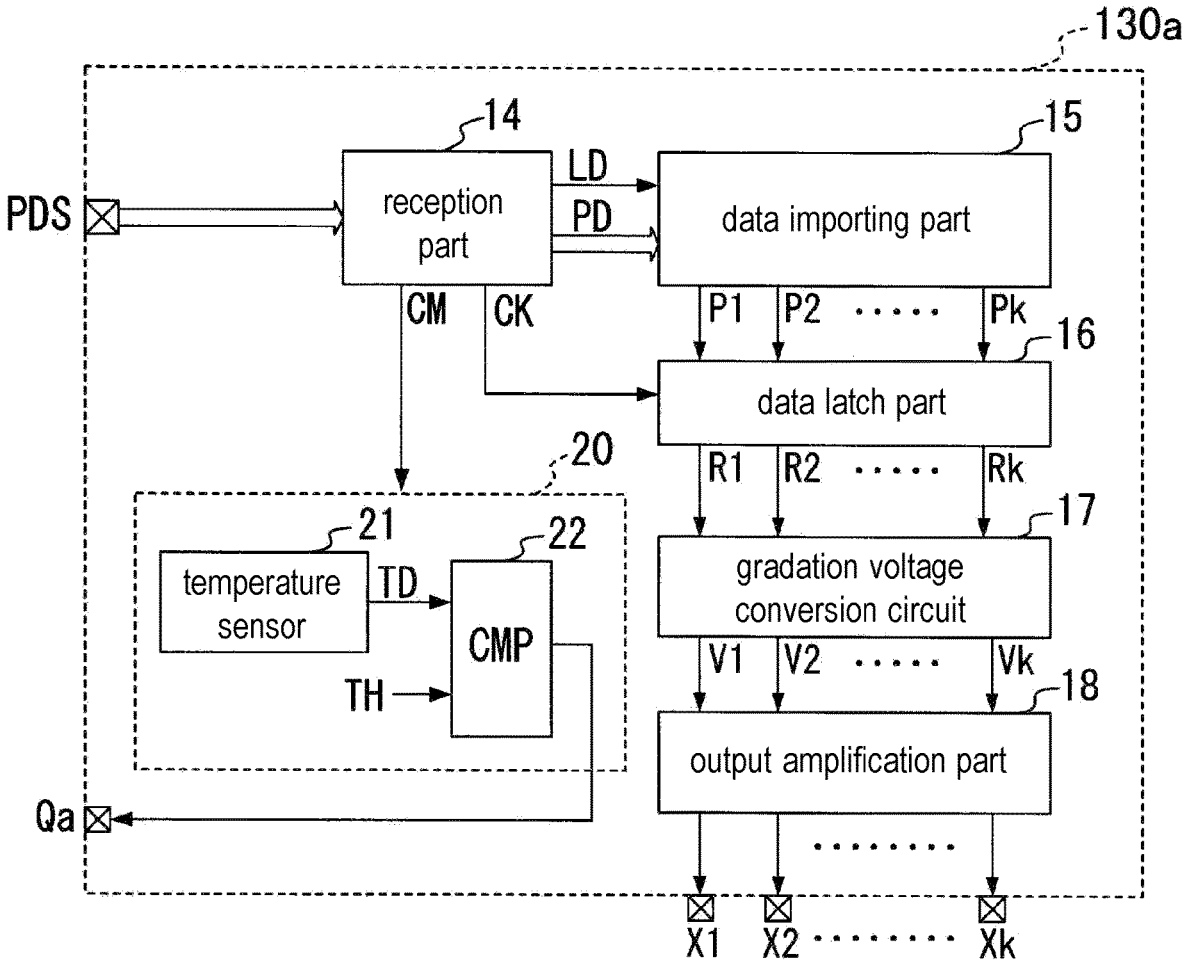
FIG. 2 is a block diagram illustrating an internal constitution of a source driver 130*a*.

FIG. 2 is a block diagram illustrating an example of a circuit formed inside the source driver 130*a*.

As illustrated in FIG. 2, a driving part including a reception part 14, a data importing part 15, a data latch part 16, a gradation voltage conversion circuit 17, and an output amplification part 18; and a temperature abnormality detection circuit 20 are formed in the source driver 130*a*.

The reception part 14 extracts a load signal from the foregoing image data signal PDS and supplies this to the data importing part 15 as a load signal LD. In addition, the reception part 14 extracts the series of pieces of pixel data PD from the image data signal PDS and supplies the series of pieces of pixel data PD to the data importing part 15. In addition, the reception part 14 generates a signal having a cycle of one horizontal scanning period as a clock signal CK on the basis of the reference timing signal included in the image data signal PDS and supplies this to the data latch part 16.

Moreover, the reception part 14 extracts a temperature detection command from the image data signal PDS and supplies this to the temperature abnormality detection circuit 20 as a temperature detection command CM.

The data importing part 15 sequentially imports the k pieces of pixel data PD from the series of pieces of pixel data PD in accordance with the load signal LD. Further, the data importing part 15 supplies the imported k pieces of pixel data PD to the data latch part 16 as pixel data P1 to pixel data Pk. The data latch part 16 latches the pixel data P1 to pixel data Pk at the same time at a timing according to the clock signal CK and supplies each of the pixel data P1 to pixel data Pk to the gradation voltage conversion circuit 17 as pixel data R1 to pixel data Rk. The gradation voltage conversion circuit 17 converts each luminance level indicated by each of the pixel data R1 to pixel data Rk into gradation voltages V1 to Vk having voltage values which individually correspond thereto and supplies the converted gradation voltages V1 to Vk to the output amplification part 18. The output amplification part 18 outputs desired voltages realized by respectively amplifying the gradation voltages V1 to Vk to driving voltages X1 to Xk. At this time, for example, the driving voltages X1 to Xk output from the output amplification part 18 of the source driver 130*a* are respectively applied to the source lines S1 to Sk of the display panel 10. Similarly, the driving voltages X1 to Xk output from the output amplification part 18 of the driver 130*b* are respectively applied to the source lines Sk+1 to Sr of the display panel 10. In addition, the driving voltages X1 to Xk output from the output amplification part 18 of the source driver 130*c* are respectively applied to the source lines Sr+1 to Sy of the display panel 10.

The temperature abnormality detection circuit 20 includes a temperature sensor 21 and a comparator 22 which operate during only a predetermined period (for example, a vertical blanking period) when the temperature detection command CM is received.

The temperature sensor 21 detects the temperature inside the source driver 130*a*, particularly the temperature around the output amplification part 18 and supplies a temperature signal TD indicating the detected temperature to the comparator 22. The comparator 22 receives the temperature signal TD and a temperature threshold TH. For example, as the temperature inside the source driver 130*a*, the temperature threshold TH indicates a temperature that is lower by a predetermined margin than the highest temperature at which normal operation thereof can be guaranteed. The comparator 22 compares the temperature threshold TH and the temperature indicated by the temperature signal TD to each other and outputs a temperature abnormality detection signal indicating "no temperature abnormality" when the temperature signal TD is equal to or lower than the temperature threshold TH. On the other hand, the comparator 22 outputs a temperature abnormality detection signal indicating "presence of a temperature abnormality" when the temperature indicated by the temperature signal TD is higher than the temperature threshold TH.

At this time, a temperature abnormality detection signal output from the temperature abnormality detection circuit 20 of the source driver 130*a* is supplied to the TCNT 11 as the foregoing temperature abnormality detection signal Qa, and a temperature abnormality detection signal output from the temperature abnormality detection circuit 20 of the source driver 130*b* is supplied to the TCNT 11 as the foregoing temperature abnormality detection signal Qb. Similarly, a temperature abnormality detection signal output from the temperature abnormality detection circuit 20 of each of the source drivers 130*c* to 130*e* is supplied to the TCNT 11 as each of the temperature abnormality detection signals Qc to Qe.

Hereinafter, temperature monitoring control executed by the TCNT 11 will be described in detail.

As illustrated in FIG. 1, the TCNT 11 includes a temperature abnormality remedy processing part 30, a temperature abnormality notification processing part 40, and a notification-on/off setting part 41 for executing the temperature monitoring control.

When a temperature abnormality in which the temperature of any of the source drivers 130*a* to 130*e* becomes a temperature higher than the temperature threshold TH is detected on the basis of the temperature abnormality detection signals Qa to Qe, the temperature abnormality remedy processing part 30 executes a temperature abnormality remedy process for reducing the temperature thereof.

The temperature abnormality notification processing part 40 has a memory (not illustrated) which stores temperature abnormality notification image data for indicating that a temperature abnormality has been detected as a display image of the display panel 10. When a temperature abnormality is detected, the temperature abnormality notification processing part 40 reads out the temperature abnormality notification image data from the memory and executes a temperature abnormality notification process in which an image based on this temperature abnormality notification image data is displayed by the display panel 10.

The notification-on/off setting part 41 stores notification designation information designating notification-on when occurrence of a temperature abnormality is notified and designating notification-off when occurrence of a temperature abnormality is not notified. For example, when a temperature evaluation test is performed after the display device 100 illustrated in FIG. 1 is assembled, the notification designation information designating notification-on is written in the notification-on/off setting part 41 in advance. On the other hand, at the time of shipment of the display device 100, the notification designation information designating notification-off is written in the notification-on/off setting part 41 as an initial setting such that an image notifying occurrence of a temperature abnormality is not displayed in the display panel 10. Namely, the temperature abnormality notification processing part 40 executes a temperature abnormality notification process in which an image notifying occurrence of a temperature abnormality is displayed in the display panel 10 when it occurs only in a case in which the notification designation information stored in the notification-on/off setting part 41 indicates notification-on. On the other hand, when the notification designation information stored in the notification-on/off setting part 41 indicates notification-off, the temperature abnormality notification processing part 40 does not perform the foregoing temperature abnormality notification process.

Figure 3:
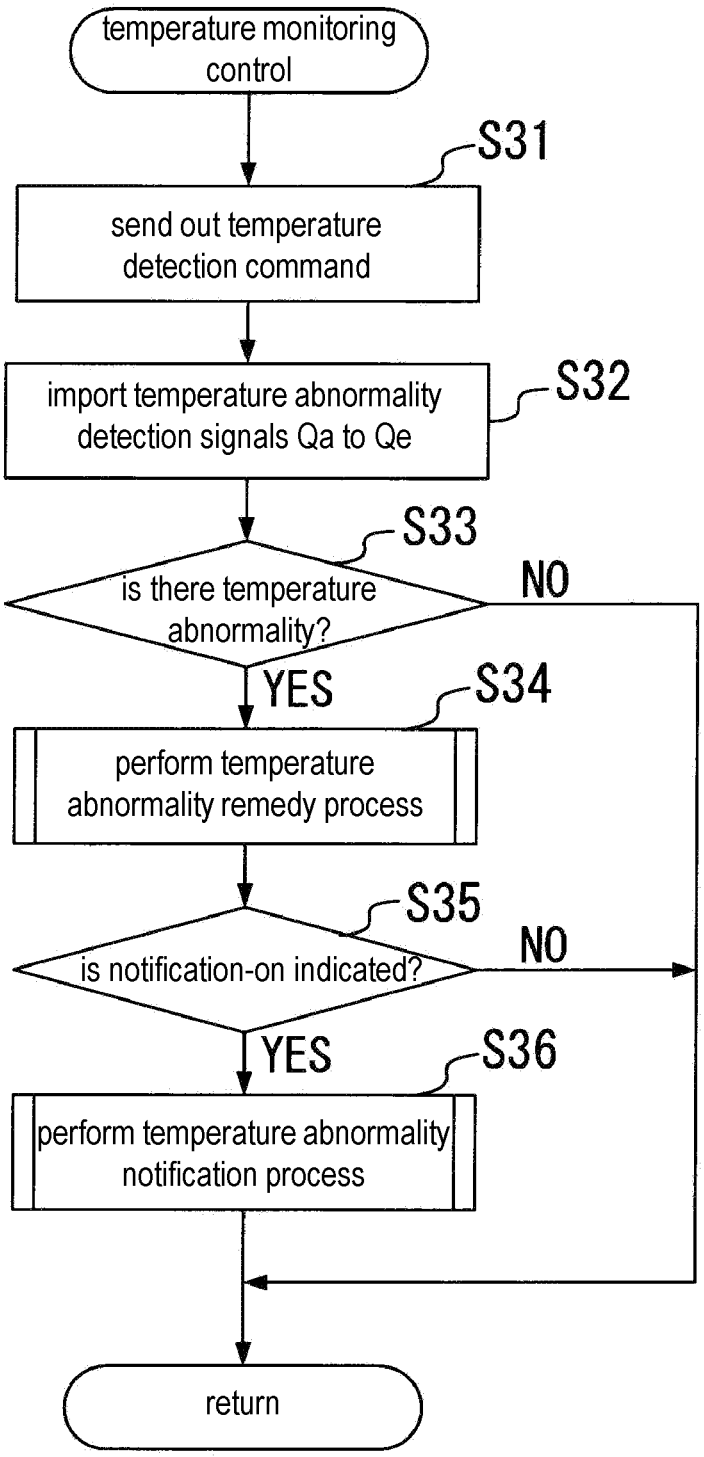
FIG. 3 is a flowchart illustrating a procedure of temperature monitoring control executed by a TCNT 11.

FIG. 3 is a flowchart illustrating a procedure of temperature monitoring control executed by the TCNT 11. The TCNT 11 executes the temperature monitoring control illustrated in FIG. 3 for each vertical blanking period, for example, in the video signal VS.

In FIG. 3, first, the TCNT 11 sends out the image data signal PDS including a temperature detection command to each of the source drivers 130*a* to 130*e* via the source driver substrate 13 (Step S31). The temperature abnormality detection circuit 20 included in each of the source drivers 130*a* to 130*e* starts to operate in accordance with the image data signal PDS, thereby detecting the internal temperature (TD) of each thereof and individually sending out the temperature abnormality detection signals Qa to Qe indicating whether or not there is a temperature abnormality to the TCNT 11.

The TCNT 11 imports the temperature abnormality detection signals Qa to Qe (Step S32) and judges whether or not any one of these temperature abnormality detection signals Qa to Qe indicates the presence of a temperature abnormality (Step S33).

In the Step S33, when it is judged the presence of a temperature abnormality is indicated, the temperature abnormality remedy processing part 30 of the TCNT 11 executes the temperature abnormality remedy process (Step S34). That is, regarding the temperature abnormality remedy process, the temperature abnormality remedy processing part 30 reduces the amplitude of each of the driving voltages X1 to Xn by a predetermined amount. Specifically, the temperature abnormality remedy processing part 30 changes the value of each piece of the pixel data PD such that the amplitude of the luminance level indicated in the series of pieces of pixel data PD is reduced by a predetermined amount. Accordingly, the amplitude of each of the driving voltages X1 to Xn generated on the basis of the series of pieces of pixel data PD is reduced. Consequently, since a current flowing inside the output amplification part 18 is reduced and the heat quantities inside the source drivers (130*a* to 130*e*) are reduced, a temperature abnormality is remedied.

Regarding another method for the temperature abnormality remedy process (S34), the temperature abnormality remedy processing part 30 may perform thinning of a group of some horizontal scanning lines from the series of pieces of pixel data PD, for example, a group of pieces of pixel data PD corresponding to even-numbered or odd-numbered horizontal scanning lines for each frame in the video signal VS. Accordingly, each of the driving voltages X1 to Xn generated on the basis of the series of pieces of pixel data PD subjected to the thinning process has a low frequency of change per unit time compared to a case in which it is not subjected to such a thinning process. Alternatively, a frame frequency of a rewriting frequency for one screen may be reduced. Consequently, since the cycle of change in currents flowing inside the output amplification part 18 is lengthened and the heat quantity inside the driver is reduced, a temperature abnormality is remedied.

Thus, according to the foregoing temperature abnormality remedy process (S34), problems such as an operation failure accompanying heat generation of the source drivers 130*a* to 130*e* can be prevented.

After execution of the foregoing Step S34, the TCNT 11 reads out the notification designation information stored in the notification-on/off setting part 41 and judges whether or not the notification designation information indicates notification-on (Step S35).

When it is judged that notification-on is indicated in the Step S35, the temperature abnormality notification processing part 40 of the TCNT 11 executes a temperature abnormality notification process (Step S36). That is, first, the temperature abnormality notification processing part 40 reads out the temperature abnormality notification image data stored in itself. Next, the temperature abnormality notification processing part 40 generates a series of pieces of pixel data for displaying an image corresponding to the temperature abnormality notification image data for a predetermined period (for example, for several seconds) using the display panel 10. Further, a series realized by inserting this generated series of pieces of pixel data into the series of pieces of pixel data PD based on the video signal VS is supplied to the data importing part 15 as a new series of pieces of pixel data PD.

Figure 4:
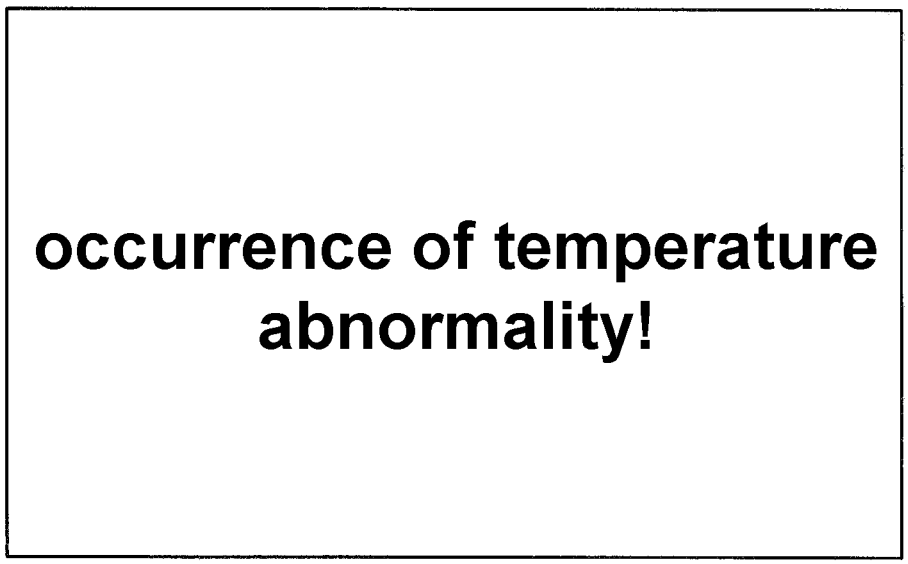
FIG. 4 is a view illustrating an example of a character image for informing that a temperature abnormality has occurred.

According to the foregoing temperature abnormality notification process, when the temperature of any of the source drivers 130*a* to 130*e* exceeds the temperature threshold TH, this is informed. For example, as illustrated in FIG. 4, a character image for informing of occurrence of a temperature abnormality is displayed in the display panel 10 for several seconds. When the notification designation information indicates notification-off, since the foregoing temperature abnormality notification process is not performed, an image for informing of occurrence of a temperature abnormality is not displayed in the display panel 10, and an image based on the video signal VS is continuously displayed.

After execution of Step S36, or when it is judged in Step S33 that there is no temperature abnormality or it is judged in Step S35 that the notification designation information indicates notification-off, the TCNT 11 ends the temperature monitoring control process illustrated in FIG. 3.

Hereinafter, operation when a temperature evaluation test is performed with respect to the foregoing display device 100 will be described. When the temperature evaluation test is performed, first, as described above, an evaluator writes notification designation information indicating notification-on in the notification-on/off setting part 41 of the TCNT 11.

Further, the evaluator supplies the video signal VS indicating a test display pattern in which the heat quantities of the source drivers 130*a* to 130*e* become comparatively high to the display device 100.

Figure 5:
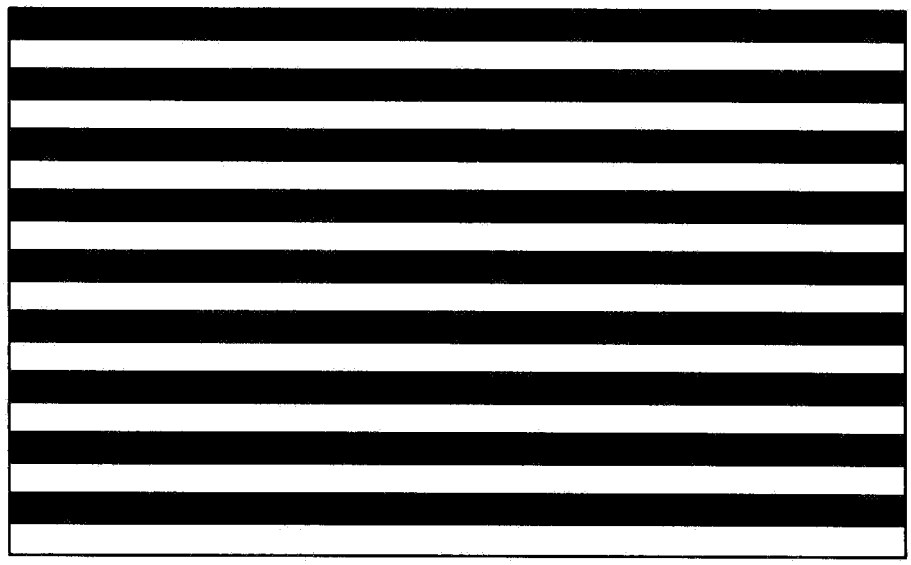
FIG. 5 is a view illustrating an example of a display pattern for a temperature evaluation test.

FIG. 5 is a view illustrating an example of a test display pattern.

That is, the evaluator supplies the video signal VS indicating the test display pattern illustrated in FIG. 5 in which white display and black display are alternately shown for each of N (N is an integer of 1 or larger) display lines (corresponding to the gate lines) to the display device 100. The heat quantities of the source drivers 130*a* to 130*e* are increased by changing the form of the test display pattern such that a white-black reverse interval indicated by the foregoing "N" is gradually reduced.

In the meantime, when the internal temperature of any one of the source drivers 130*a* to 130*e* exceeds the temperature threshold TH, the temperature abnormality remedy process (S34) is performed. Moreover, for example, as illustrated in FIG. 4, an image notifying that a temperature abnormality has occurred is displayed in the display panel 10. Hence, on the basis of the white-black reverse interval N of the test display pattern input to the display device 100 at the time when this display is visually confirmed, the evaluator performs limit evaluation of the source drivers 130*a* to 130*e* which have become targets of the temperature evaluation test.

In this manner, according to the display device 100 illustrated in FIGS. 1 and 2, the evaluator can be informed in real time whether or not a temperature abnormality in which the temperatures of the source drivers 130*a* to 130*e* exceed a predetermined threshold TH has occurred according to visual confirmation from the display image of the display panel 10.

Thus, the temperature evaluation test can be performed without requiring troublesome work such as connection of a probe of a tester to terminals of the source drivers 130*a* to 130*e* for monitoring whether or not a temperature abnormality has occurred on the evaluator side.

In the foregoing Example, a constitution of a case in which the temperature abnormality remedy processing part 30, the temperature abnormality notification processing part 40, and the notification-on/off setting part 41 are provided inside the TCNT 11 has been described. However, the functions of the temperature abnormality remedy processing part 30, the temperature abnormality notification processing part 40, and the notification-on/off setting part 41 may be provided inside each of the source drivers 130*a* to 130*e*.

Example 2

Figure 6:
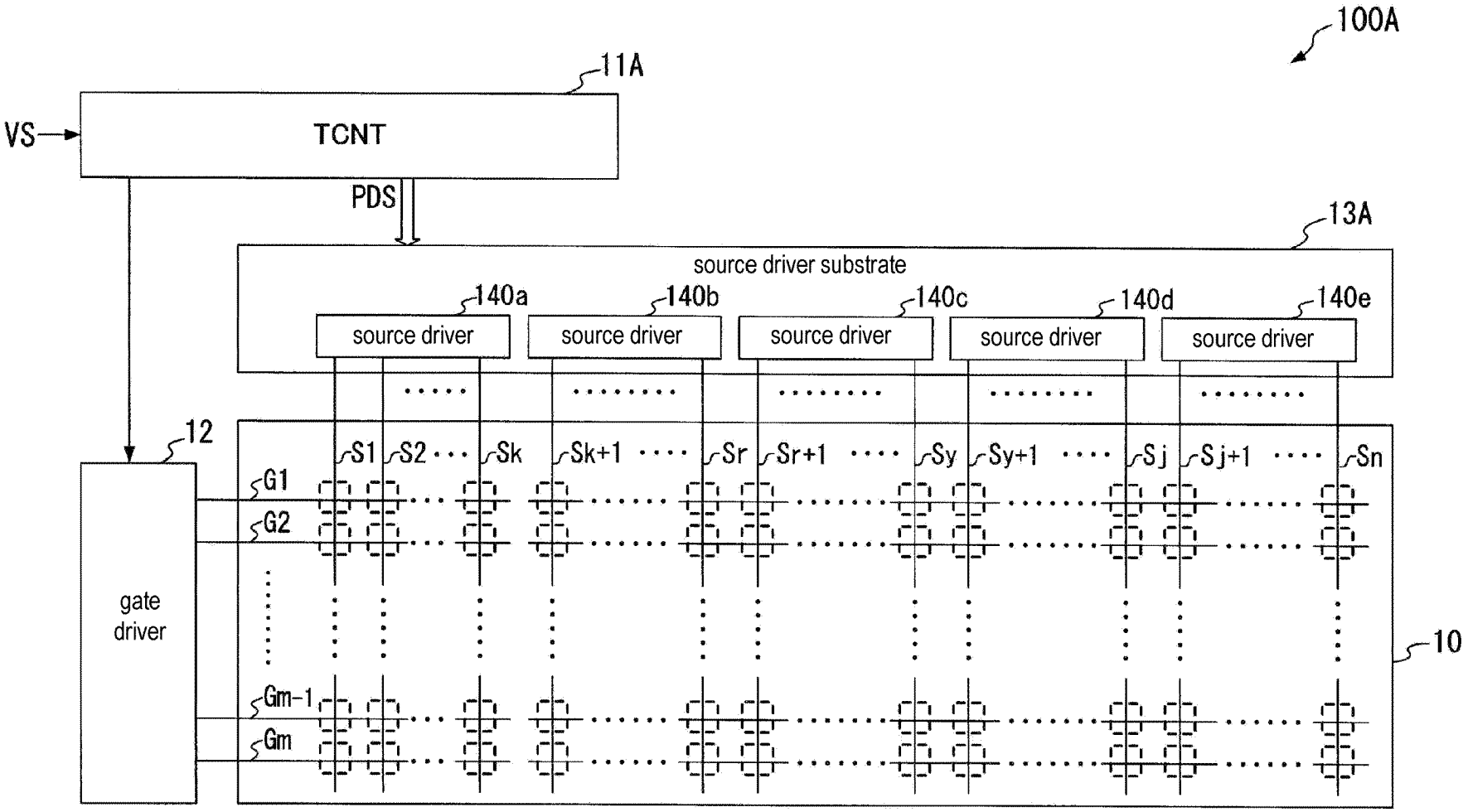
FIG. 6 is a view showing another example of a schematic constitution of the display device 100 including the source driver according to the disclosure.

FIG. 6 is a view illustrating an example of a schematic constitution of a display device 100A that is another example of the display device according to the disclosure which has been made in consideration of such points. In the constitution illustrated in FIG. 6, a TCNT 11A is employed instead of the TCNT 11 and a source driver substrate 13A having a plurality of source drivers (140*a* to 140*e*) is employed instead of the source driver substrate 13, and the constitution is otherwise the same as the display device 100 illustrated in FIG. 1.

Here, the constitution and the operation of each of the TCNT 11A and the plurality of source drivers (140*a* to 140*e*) will be mainly described below.

The TCNT 11A is realized by eliminating the functions of the temperature abnormality remedy processing part 30, the temperature abnormality notification processing part 40, and the notification-on/off setting part 41 from the TCNT 11.

The TCNT 11A receives the video signal VS, extracts a horizontal synchronization signal from the video signal VS, and supplies this to the gate driver 12.

Moreover, the TCNT 11A generates a series of pieces of pixel data PD individually indicating a luminance level of each pixel in 8-bit data, for example, on the basis of the video signal VS. In addition, the TCNT 11A generates a reference timing signal which becomes a reference for a clock signal and a load signal which indicates a timing for starting to import the pixel data and generates a temperature detection command prompting execution of a temperature detection process for each vertical blanking period in the video signal VS.

Further, as an image data signal PDS, the TCNT 11A supplies a signal, which is realized by applying the reference timing signal, the load signal, and the temperature detection command described above to the generated series of pieces of pixel data PD, to each of the plurality of source drivers (140*a* to 140*e*) via the source driver substrate 13A.

The source driver substrate 13A has the source drivers 140*a* to 140*e*.

Similar to the source drivers 130*a* to 130*e*, each of the source drivers 140*a* to 140*e* is constituted of an independent semiconductor IC chip. In addition, similar to the source drivers 130*a* to 130*e*, each of the source drivers 140*a* to 140*e* is used for driving division source line groups (S1 to Sk, Sk+1 to Sr, Sr+1 to Sy, Sy+1 to Sj, and Sj+1 to Sn) in which the source lines S1 to Sn of the display panel 10 are divided into five groups. Each of the source drivers 140*a* to 140*e* receives the image data signal PDS and imports the series of pieces of pixel data PD corresponding to itself from the image data signal PDS in accordance with the load signal included in the image data signal PDS. Further, each of the source drivers 140*a* to 140*e* converts each piece of the imported pixel data PD into a driving voltage having a voltage value corresponding to the luminance level indicated by each of the source drivers 140*a* to 140*e* and applies the converted driving voltage to the source lines corresponding to each of the source drivers 140*a* to 140*e*.

Hereinafter, constitutions of the source drivers 140*a* to 140*e* will be described.

The same circuit is formed in each of the source drivers 140*a* to 140*e*. Hence, the source driver 140*a* is selected for describing the circuit formed in each of the source drivers.

Figure 7:
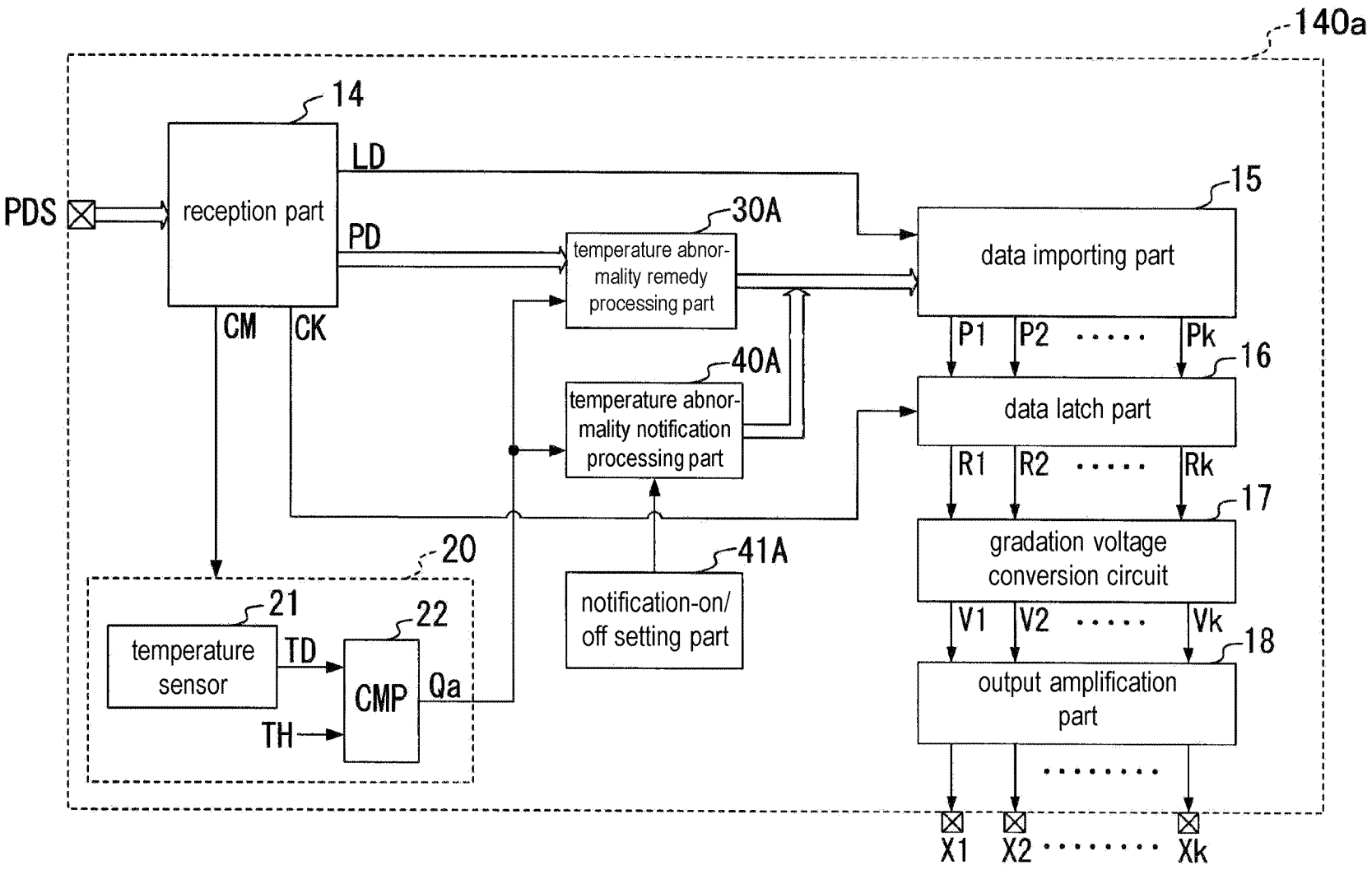
FIG. 7 is a block diagram illustrating an internal constitution of a source driver 140*a*.

FIG. 7 is a block diagram illustrating an example of a circuit formed inside the source driver 140*a*.

As illustrated in FIG. 7, the source driver 140*a* includes a driving part including the reception part 14, the data importing part 15, the data latch part 16, the gradation voltage conversion circuit 17, and the output amplification part 18; the temperature abnormality detection circuit 20; a temperature abnormality remedy processing part 30A; a temperature abnormality notification processing part 40A; and a notification-on/off setting part 41A.

Operation of the reception part 14, the data importing part 15, the data latch part 16, the gradation voltage conversion circuit 17, and the output amplification part 18 is the same as that included in the driver 130*a* illustrated in FIG. 2. However, the reception part 14 supplies the series of pieces of pixel data PD extracted from the image data signal PDS to the temperature abnormality remedy processing part 30A instead of the data importing part 15.

The temperature abnormality detection circuit 20 includes the temperature sensor 21 and the comparator 22 which operate during only a predetermined period (for example, a vertical blanking period) when the temperature detection command CM is received from the reception part 14. The temperature sensor 21 detects the temperature inside the driver 140*a* (140*b* to 140*e*), particularly the temperature around the output amplification part 18 and supplies the temperature signal TD indicating the detected temperature to the comparator 22. The comparator 22 compares the temperature threshold TH described above and the temperature indicated by the temperature signal TD to each other, and the comparator 22 supplies the temperature abnormality detection signal Qa indicating "no temperature abnormality" to the temperature abnormality remedy processing part 30A and the temperature abnormality notification processing part 40A when the temperature signal TD is equal to or lower than the temperature threshold TH. On the other hand, when the temperature signal TD is higher than the temperature threshold TH, the temperature abnormality detection signal Qa indicating "presence of a temperature abnormality" is supplied to the temperature abnormality remedy processing part 30A and the temperature abnormality notification processing part 40A.

When the temperature abnormality detection signal Qa indicates no temperature abnormality, the temperature abnormality remedy processing part 30A supplies the series of pieces of pixel data PD supplied from the reception part 14 to the data importing part 15 as it stands. On the other hand, when the temperature abnormality detection signal Qa indicates the presence of a temperature abnormality, namely when a temperature abnormality in which the temperature of the driver 140*a* becomes a temperature higher than the temperature threshold TH is detected, the temperature abnormality remedy processing part 30A performs a temperature abnormality remedy process for reducing the temperature thereof with respect to the series of pieces of pixel data PD. The temperature abnormality remedy processing part 30A outputs the series of pieces of pixel data PD subjected to this temperature abnormality remedy process and supplies the output series of pieces of pixel data PD to the data importing part 15.

The temperature abnormality notification processing part 40A has a memory (not illustrated) which stores temperature abnormality notification image data for notifying that a temperature abnormality has been detected as a display image of the display panel 10. The temperature abnormality notification processing part 40A executes a temperature abnormality notification process when the temperature abnormality detection signal Qa indicates the presence of a temperature abnormality, namely when a temperature abnormality in which the temperature of the driver 140*a* becomes a temperature higher than the temperature threshold TH is detected. For example, regarding the temperature abnormality notification process, first, the temperature abnormality notification processing part 40A reads out the temperature abnormality notification image data from the memory. Further, the temperature abnormality notification processing part 40A inserts a series of pieces of pixel data indicating an image based on the temperature abnormality notification image data into the series of pieces of pixel data PD output from the temperature abnormality remedy processing part 30A.

Similar to the notification-on/off setting part 41, the notification-on/off setting part 41A stores notification designation information designating notification-on when occurrence of a temperature abnormality is notified and designating notification-off when occurrence of a temperature abnormality is not notified. For example, when a temperature evaluation test is performed after the display device 100A illustrated in FIG. 6 is assembled, the notification designation information designating notification-on is written in the notification-on/off setting part 41A in advance. In addition, at the time of shipment of the display device 100A, the notification designation information designating notification-off is written in the notification-on/off setting part 41A. The notification-on/off setting part 41A supplies the notification designation information to the temperature abnormality notification processing part 40A. The temperature abnormality notification processing part 40A performs the foregoing temperature abnormality notification process with respect to the series of pieces of pixel data PD only in a case in which the notification designation information indicates notification-on. On the other hand, when the notification designation information stored in the notification-on/off setting part 41A indicates notification-off, the temperature abnormality notification processing part 40A does not perform the temperature abnormality notification process.

Figure 8:
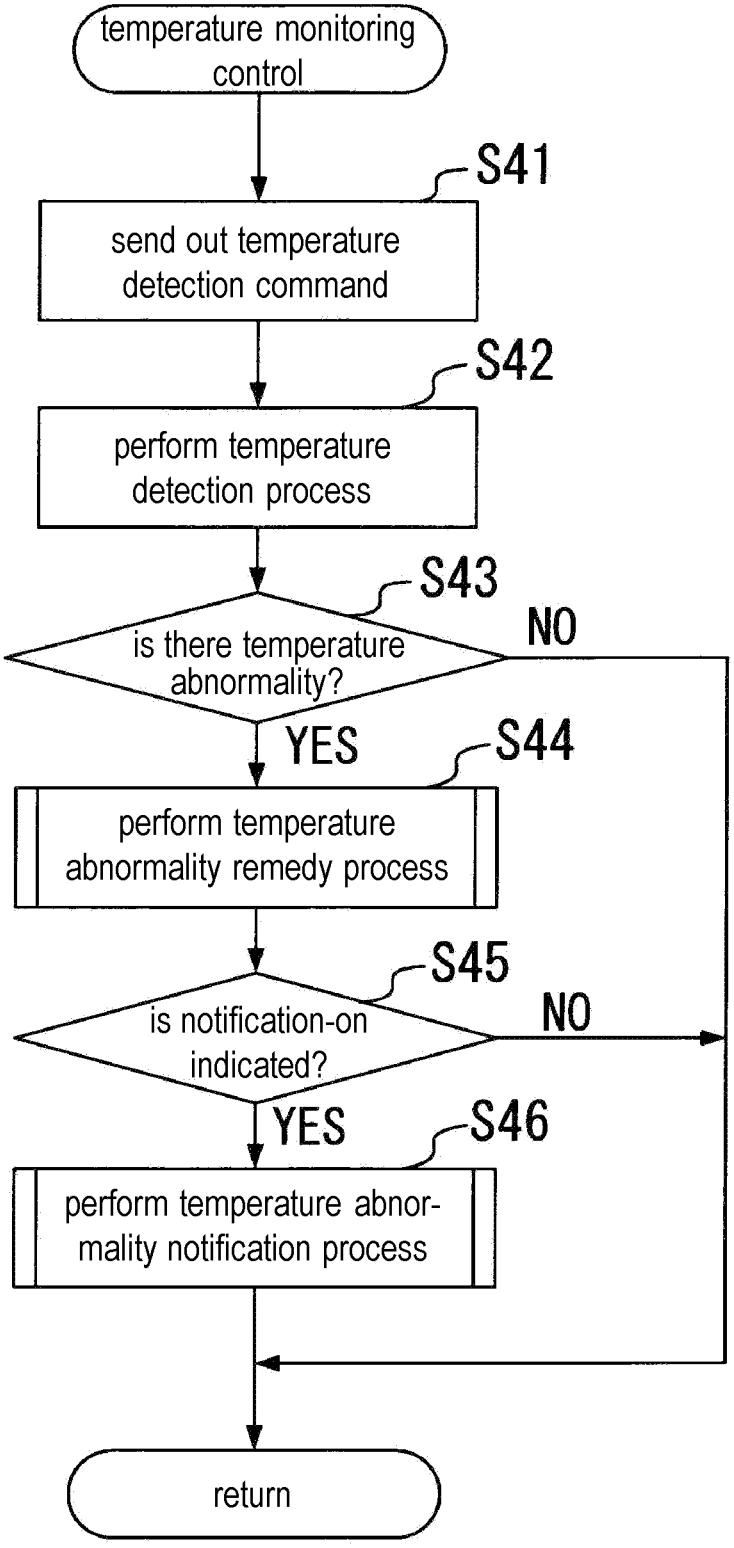
FIG. 8 is a flowchart illustrating a procedure of temperature monitoring control executed by a temperature abnormality remedy processing part 30A, a temperature abnormality notification processing part 40A, and a notification-on/off setting part 41A.

FIG. 8 is a flowchart illustrating a procedure of temperature monitoring control performed by the reception part 14, the temperature abnormality detection circuit 20, the temperature abnormality remedy processing part 30A, the temperature abnormality notification processing part 40A, and the notification-on/off setting part 41A of each of the source drivers 140*a* to 140*e* when the image data signal PDS including a temperature detection command is received.

In FIG. 8, first, the reception part 14 supplies a temperature detection command included in the image data signal PDS to the temperature abnormality detection circuit 20 as the temperature detection command CM (Step S41).

The temperature abnormality detection circuit 20 performs the temperature detection process in accordance with the temperature detection command CM (Step S42). That is, first, the temperature sensor 21 of the temperature abnormality detection circuit 20 starts to detect the temperature inside the driver and generates the temperature signal TD indicating the temperature thereof. Here, the temperature abnormality detection circuit 20 generates the temperature abnormality detection signal Qa indicating "presence of a temperature abnormality" when the temperature signal TD is higher than the temperature threshold TH and indicating "no temperature abnormality" when the temperature signal TD is equal to or lower than the temperature threshold TH.

Next, the temperature abnormality remedy processing part 30A judges whether or not the temperature abnormality detection signal Qa indicates the presence of a temperature abnormality (Step S43). In the Step S43, when it is judged that the presence of a temperature abnormality is indicated, the temperature abnormality remedy processing part 30A executes the temperature abnormality remedy process (Step S44). That is, regarding the temperature abnormality remedy process, the temperature abnormality remedy processing part 30A reduces the amplitude of each of the driving voltages X1 to Xn by a predetermined amount. Specifically, the temperature abnormality remedy processing part 30A changes the value of each piece of the pixel data PD such that the amplitude of the luminance level indicated in the series of pieces of pixel data PD is reduced by a predetermined amount. Accordingly, the amplitude of each of the driving voltages X1 to Xn generated on the basis of the series of pieces of pixel data PD is reduced. Consequently, since a current flowing inside the output amplification part 18 is reduced and the heat quantities inside the source drivers (140*a* to 140*e*) are reduced, a temperature abnormality is remedied.

Regarding another method for the temperature abnormality remedy process (S44), the temperature abnormality remedy processing part 30A may perform thinning of a group of some horizontal scanning lines from the series of pieces of pixel data PD, for example, a group of pieces of pixel data PD corresponding to even-numbered or odd-numbered horizontal scanning lines for each frame in the video signal VS. Accordingly, each of the driving voltages X1 to Xn generated on the basis of the series of pieces of pixel data PD subjected to the thinning process has a low frequency of change per unit time compared to a case in which it is not subjected to such a thinning process. Alternatively, a frame frequency of a rewriting frequency for one screen may be reduced. Consequently, since the cycle of change in currents flowing inside the output amplification part 18 is lengthened and the heat quantity inside the driver is reduced, a temperature abnormality is remedied.

Thus, according to the foregoing temperature abnormality remedy process (S44), problems such as an operation failure accompanying heat generation of the source drivers 140*a* to 140*e* can be prevented.

After execution of the foregoing Step S44, the temperature abnormality notification processing part 40A judges whether or not the notification designation information supplied from the notification-on/off setting part 41A indicates notification-on (Step S45). In the Step S45, when it is judged that notification-on is indicated, the temperature abnormality notification processing part 40A executes a temperature abnormality notification process (Step S46). That is, first, the temperature abnormality notification processing part 40A reads out the temperature abnormality notification image data stored in itself. Next, the temperature abnormality notification processing part 40A generates a series of pieces of pixel data for displaying an image corresponding to the temperature abnormality notification image data for a predetermined period (for example, for several seconds) using the display panel 10. Further, a series realized by inserting this generated series of pieces of pixel data into the series of pieces of pixel data PD based on the video signal VS is supplied to the data importing part 15 as a new series of pieces of pixel data PD.

Thus, according to the foregoing temperature abnormality notification process (S46), when the temperature of any of the source drivers 140*a* to 140*e* exceeds the temperature threshold TH, this is informed. For example, as illustrated in FIG. 4, a character image for informing of occurrence of a temperature abnormality is displayed in the display panel 10 for several seconds. When the notification designation information indicates notification-off, since the foregoing temperature abnormality notification process (S46) is not performed, an image for informing of occurrence of a temperature abnormality is not displayed in the display panel 10, and an image based on the video signal VS is continuously displayed.

After execution of Step S46, or when it is judged in Step S43 that there is no temperature abnormality or it is judged in Step S45 that the notification designation information indicates notification-off, the temperature monitoring control process illustrated in FIG. 8 is ended and is in a standby state for receiving a temperature detection command.

Hereinafter, operation when a temperature evaluation test is performed with respect to the foregoing display device 100A will be described. When the temperature evaluation test is performed, an evaluator writes notification designation information indicating notification-on in the notification-on/off setting part 41A of each of the source drivers 140*a* to 140*e*.

Further, the evaluator supplies the video signal VS indicating a test display pattern in which the heat quantities of the source drivers 140*a* to 140*e* become high to the display device 100A.

That is, the evaluator supplies the video signal VS indicating the test display pattern illustrated in FIG. 5 in which white display and black display are alternately shown for each of N (N is an integer of 1 or larger) display lines (corresponding to the gate lines) to the display device 100A. The heat quantity of the source driver substrate 13A is increased by changing the form of the test display pattern such that a white-black reverse interval indicated by the foregoing "N" is gradually reduced.

In the meantime, when the internal temperature of any one of the source drivers 140*a* to 140*e* exceeds the temperature threshold TH, the temperature abnormality remedy process (S44) is performed. Moreover, for example, as illustrated in FIG. 4, an image notifying that a temperature abnormality has occurred is displayed in the display panel 10. Hence, on the basis of the white-black reverse interval N of the test display pattern input to the display device 100A at the time when this display is visually confirmed, the evaluator performs limit evaluation of the source driver substrate 13A which has become a target of the temperature evaluation test.

In the foregoing Example, an image indicating that a temperature abnormality has occurred is a character image as illustrated in FIG. 4. However, instead of this, an image of a unique particular pattern which is not present in the test display pattern may be displayed. That is, first, for example, image data indicating an image of a single color or a particular pattern having few changes in pattern within a frame is written in the temperature abnormality notification processing part 40 (40A) as the temperature abnormality notification image data.

Accordingly, when a temperature abnormality has occurred, since the image displayed by the display panel 10 is switched from the test display pattern illustrated in FIG. 5 to the foregoing particular pattern for a predetermined period, the evaluator can be informed in real time that a temperature abnormality has occurred. Moreover, while the particular pattern is displayed, since the amount of electricity consumed by the source drivers 130*a* to 130*e* (140*a* to 140*e*) is reduced compared to that while the test display pattern is displayed, the internal temperatures of the source drivers 130*a* to 130*e* (140*a* to 140*e*) are also reduced. Thus, in the temperature monitoring control described above, even if the temperature abnormality remedy process (S34, S44) is not executed, an operation failure or the like accompanying a temperature abnormality of the source drivers can be avoided.

In addition, in the foregoing Example, whether or not a temperature abnormality has occurred is judged on the basis of the temperature threshold TH. However, the form of the particular pattern may be switched in stages depending on the level of the temperature thereof when the internal temperatures of the source drivers 130*a* to 130*e* (140*a* to 140*e*) exceed the temperature threshold TH and the temperature further rises.

For example, temperature abnormality notification image data individually indicating particular patterns 1 and 2 having single colors different from each other is written in the temperature abnormality notification processing part 40 (40A) in advance. In Step S36 (S46), first, the temperature abnormality notification processing part 40 (40A) reads out the temperature abnormality notification image data. Here, when the temperature signal TD is larger than the temperature threshold TH and is equal to or smaller than a limit temperature threshold THw (TH<THw) as illustrated in FIG. 9, the temperature abnormality notification processing part 40 (40A) performs a temperature abnormality notification process in which the particular pattern 1 indicated by the temperature abnormality notification image data is displayed for a predetermined period.

Figure 9:
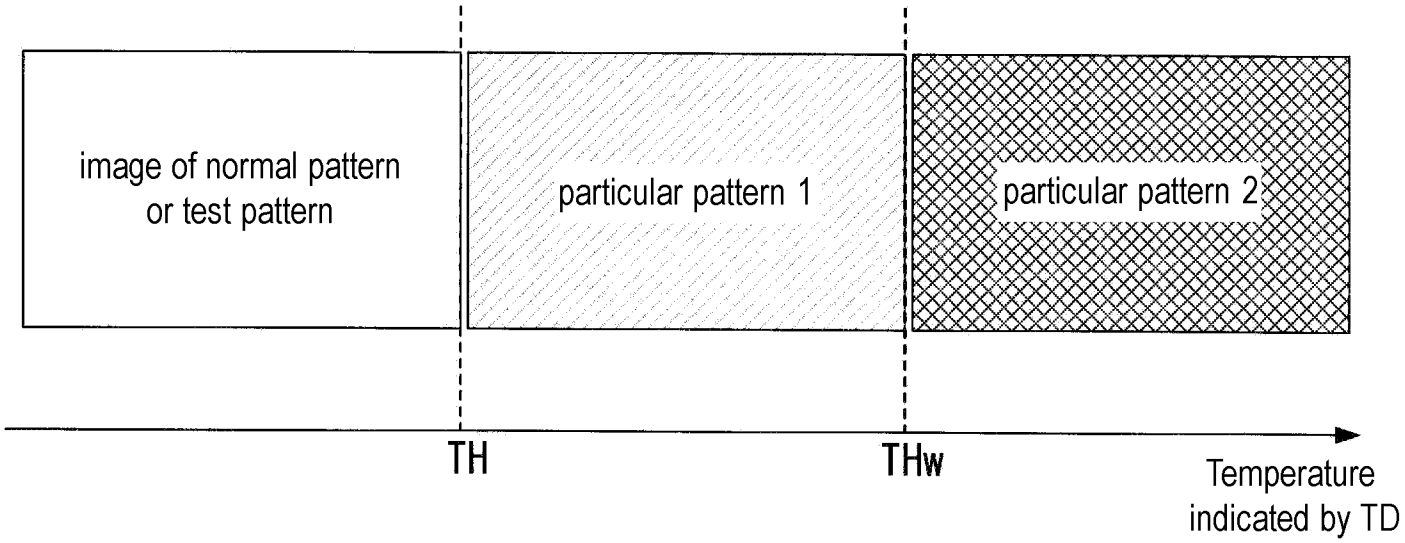
FIG. 9 is a view showing an example of an image (particular patterns 1 and 2) switched between two stages when the fact that a temperature abnormality has occurred is displayed in a display panel 10 in accordance with a level of the temperature thereof.

In addition, when the temperature signal TD is larger than the limit temperature threshold THw, the temperature abnormality notification processing part 40 (40A) performs a temperature abnormality notification process in which the particular pattern 2 is displayed instead of the particular pattern 1 as illustrated in FIG. 9.

For example, the temperature threshold TH illustrated in FIG. 9 may indicate an upper limit temperature of the source driver substrate 13 (13A) in the specification to which a predetermined margin is added, and the limit temperature threshold THw may indicate an upper limit temperature at which abnormal operation of the source driver substrate 13 (13A) is caused.

Thus, the evaluator can be informed whether the temperature of the source driver is within the temperature threshold TH, is within a range of the temperature threshold TH to the limit temperature threshold THw, or exceeds the limit temperature threshold THw according to visual confirmation from the form (a test pattern, the particular pattern 1, or the particular pattern 2) of the image displayed in the display panel 10.

In addition, in the example illustrated in FIG. 9, regarding an image for informing of occurrence of a temperature abnormality, two particular patterns 1 and 2 indicating image forms different from each other are prepared. However, the number of particular patterns is not limited to two. In short, three or more particular patterns indicating image forms different from each other may be prepared, and one image corresponding to the level of the temperature indicated by the temperature signal TD may be selected from the images of the plurality of particular patterns and displayed by the display panel 10.

In addition, in the foregoing Example, temperature abnormality notification image data indicating an image (including a particular pattern) for notification of a temperature abnormality is prepared in advance. However, an image indicating that a temperature abnormality has occurred may be displayed without using this temperature abnormality notification image data.

For example, when the temperature signal TD is equal to or lower than the temperature threshold TH, the temperature abnormality notification processing part 40 (40A) causes an image based on the video signal VS to be displayed. Here, when the temperature signal TD becomes larger than the temperature threshold TH, namely when the temperature abnormality detection signal Qa indicating the presence of a temperature abnormality is received, the temperature abnormality notification processing part 40 (40A) drastically changes the display forms (for example, the luminance level, the color temperature, the chroma, and the resolution) of the entire image based on the video signal VS. Namely, the temperature abnormality notification processing part 40 (40A) informs the evaluator that a temperature abnormality has occurred by drastically changing the display forms of the entire image based on the video signal VS in accordance with the temperature abnormality detection signal Qa indicating the presence of a temperature abnormality.

Figure 10:
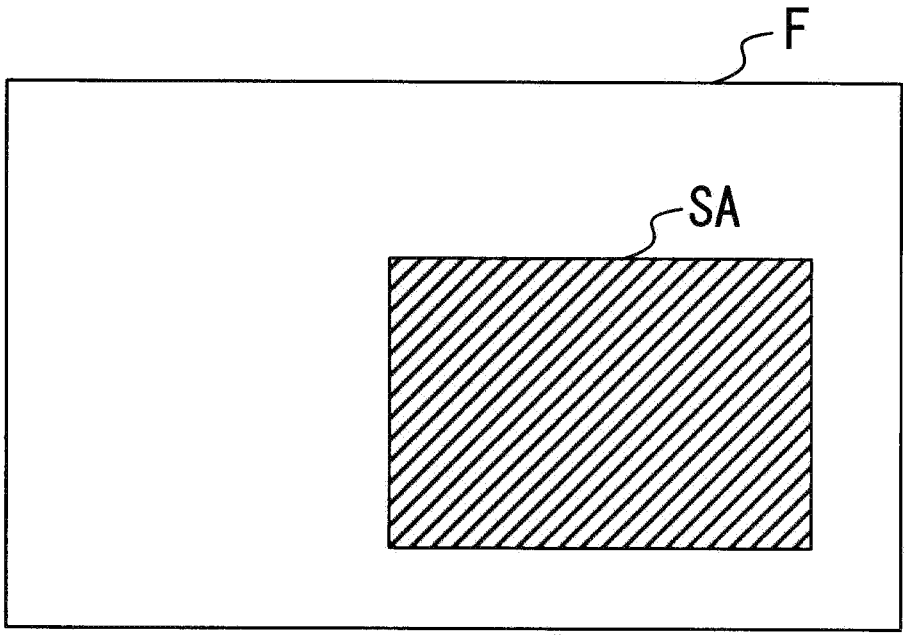
FIG. 10 is a view showing another example of an image for informing that a temperature abnormality has occurred.
Figure 11:
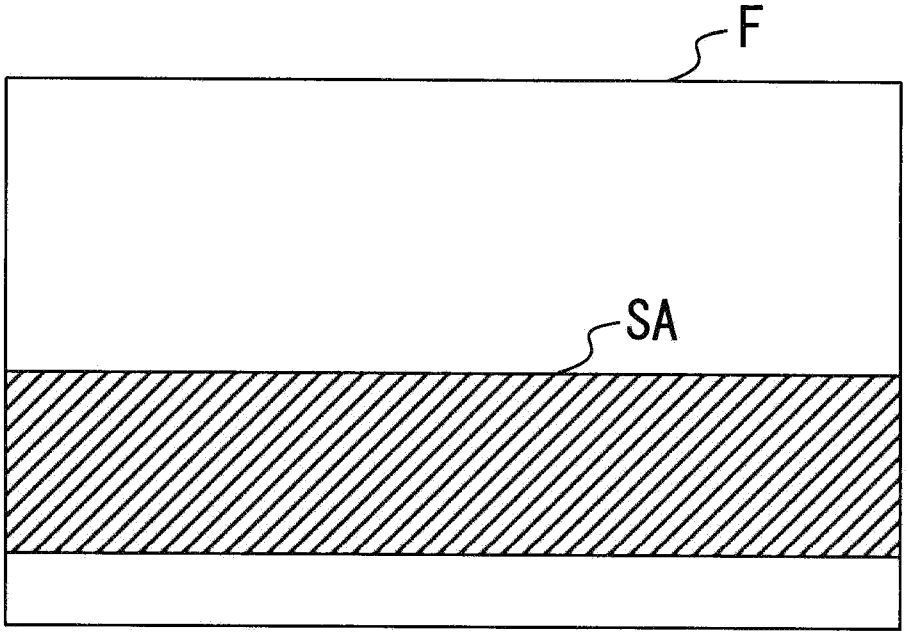
FIG. 11 is a view showing another example of an image for informing that a temperature abnormality has occurred.

Incidentally, regarding an image informing the evaluator that a temperature abnormality has occurred, for example, as illustrated in FIG. 10 or 11, only a partial region SA in an image F based on the video signal VS may employ a pattern in which the display forms (for example, the luminance level, the color temperature, the chroma, and the resolution) thereof are changed.

For example, the temperature abnormality notification processing part 40 (40A) reduces the amplitude of each of the driving voltages used for displaying the partial region SA illustrated in FIG. 10 or 11 by a predetermined amount in accordance with the temperature abnormality detection signal Qa indicating the presence of a temperature abnormality.

Specifically, the temperature abnormality notification processing part 40 (40A) changes the value of each piece of the pixel data PD such that the amplitude of the luminance level indicated in the series of pieces of pixel data PD corresponding to the partial region SA is reduced by a predetermined amount. Accordingly, a luminance fall occurs in only the partial region SA in the image F based on the video signal VS. Namely, the evaluator is informed that a temperature abnormality has occurred on the basis of change (luminance fall) in the display form in the partial region SA.

In addition, for example, the temperature abnormality notification processing part 40 (40A) may perform thinning of a group of pieces of pixel data PD corresponding to each of the horizontal scanning lines which belong to the partial region SA illustrated in FIG. 11 from the series of pieces of pixel data PD within the frame for each frame in the video signal VS in accordance with the temperature abnormality detection signal Qa indicating the presence of a temperature abnormality. Accordingly, as illustrated in FIG. 11, deterioration in resolution occurs in only the partial region SA in the image F based on the video signal VS. Namely, the evaluator is informed that a temperature abnormality has occurred on the basis of change (deterioration in resolution) in the display form in the partial region SA.

Thus, according to the foregoing display method, it is no longer necessary to prepare the temperature abnormality notification image data and have a memory for storing the temperature abnormality notification image data.

A display driver including the TCNT 11 (11A) serving as a control unit, and the source drivers 130*a* to 130*e* (140*a* to 140*e*) need only have a temperature abnormality detection circuit and a temperature abnormality notification processing part as described below.

The temperature abnormality detection circuit (20) detects the temperature inside the display driver and generates the temperature abnormality detection signal (for example, Qa) indicating the presence of a temperature abnormality when this temperature is higher than the predetermined temperature threshold (TH). The temperature abnormality notification processing parts (40, 40A) cause the display panel (10) to display an image for informing of occurrence of a temperature abnormality for a predetermined period instead of an image based on the video signal in accordance with the temperature abnormality detection signal.

Regarding the temperature abnormality notification processing parts (40, 40A), processing parts that change the display form of the partial region (SA) in an image based on the video signal VS in accordance with the temperature abnormality detection signal indicating the presence of a temperature abnormality may be employed.

Thus, according to the foregoing constitution, an evaluator performing a temperature evaluation test with respect to a display driver connected to a display panel can be informed in real time whether or not a temperature abnormality has occurred in the display driver according to visual confirmation from a display image of this display panel. Thus, since there is no longer a need for the evaluator to perform troublesome work, such as connection of a probe of a tester to an external terminal of the display driver for being informed whether or not a temperature abnormality has occurred, a temperature evaluation test with respect to the display driver can be easily performed.

In the disclosure, when the temperature inside the source driver becomes higher than a predetermined temperature threshold, the display panel is caused to display an image for informing of occurrence of a temperature abnormality for a predetermined period instead of an image based on a video signal.

According to the constitution, an evaluator performing a temperature evaluation test with respect to the source driver can be informed whether or not a temperature abnormality has occurred in the source driver according to visual confirmation from a display image of the display panel. Thus, there is no longer a need for the evaluator to perform troublesome work, such as connection of a probe of a tester to a terminal of the source driver for monitoring whether or not a temperature abnormality has occurred. Therefore, according to the disclosure, a temperature evaluation test with respect to the source driver can be easily performed.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A display driver that performs driving for causing a display panel to display an image based on a video signal, the display driver comprising:

a temperature abnormality detection circuit that detects a temperature inside the display driver and generates a temperature abnormality detection signal indicating presence of a temperature abnormality when the temperature is higher than a predetermined temperature threshold; and a temperature abnormality notification processing part that causes the display panel to display an image for informing of occurrence of a temperature abnormality for a predetermined period instead of an image based on the video signal in accordance with the temperature abnormality detection signal.

2. The display driver according to claim 1 comprising:

a control unit that generates a series of pixel data pieces indicating a luminance level of each pixel based on the video signal;

a driving part that individually converts each of the pixel data pieces in the series of pixel data pieces into a driving voltage having a voltage value corresponding to the luminance level and supplies a plurality of driving voltages converted to the display panel; and a temperature abnormality remedy processing part that avoids the temperature abnormality by performing thinning of a pixel data piece group corresponding to each of horizontal scanning lines of a portion within a frame from the series of pixel data pieces for each frame in the video signal, reducing an amplitude of each of the plurality of driving voltages, or reducing a frame frequency in accordance with the temperature abnormality detection signal.

3. The display driver according to claim 2 comprising:

a notification-on/off setting part that stores notification designation information designating whether or not to notify occurrence of the temperature abnormality, wherein the temperature abnormality notification processing part causes the display panel to display an image for informing of occurrence of the temperature abnormality in accordance with the temperature abnormality detection signal only in a case in which the notification designation information indicates that notification is to be performed.

4. The display driver according to claim 2, wherein the control unit and the temperature abnormality notification processing part are formed in a first semiconductor IC chip, and wherein the driving part and the temperature abnormality detection circuit are formed in a second semiconductor IC chip.

5. The display driver according to claim 2, wherein the control unit is formed in a first semiconductor IC chip, and wherein the driving part, the temperature abnormality notification processing part, and the temperature abnormality detection circuit are formed in a second semiconductor IC chip.

6. The display driver according to claim 1 comprising:

a notification-on/off setting part that stores notification designation information designating whether or not to notify occurrence of the temperature abnormality, wherein the temperature abnormality notification processing part causes the display panel to display an image for informing of occurrence of the temperature abnormality in accordance with the temperature abnormality detection signal only in a case in which the notification designation information indicates that notification is to be performed.

7. The display driver according to claim 1, wherein the temperature abnormality notification processing part causes the display panel to display an image for informing of occurrence of the temperature abnormality in characters as an image for informing of occurrence of the temperature abnormality.

8. The display driver according to claim 1, wherein the temperature abnormality notification processing part selects one image corresponding to a level of the temperature from images having a plurality of particular patterns respectively indicating different image forms and causes the display panel to display the one image selected as an image for informing of occurrence of the temperature abnormality.

9. The display driver according to claim 1, wherein the temperature abnormality notification processing part causes the display panel to display an image of a single color or a particular pattern having few changes in pattern within a frame as an image for informing of occurrence of the temperature abnormality.

10. A display driver that performs driving for causing a display panel to display an image based on a video signal, the display driver comprising:

a temperature abnormality detection circuit that detects a temperature inside the display driver and generates a temperature abnormality detection signal indicating presence of a temperature abnormality when the temperature is higher than a predetermined temperature threshold; and a temperature abnormality notification processing part that changes a display form of a region of a portion in an image based on the video signal in accordance with the temperature abnormality detection signal, wherein the temperature abnormality notification processing part performs thinning of a pixel data piece group corresponding to each of horizontal scanning lines which belong to the region of the portion from series of pixel data pieces within a frame for each frame in the video signal, or reduces an amplitude of each of driving voltages used for displaying the region of the portion in accordance with the temperature abnormality detection signal.

11. The display driver according to claim 10 comprising:

a control unit that generates the series of pixel data pieces indicating a luminance level of each pixel based on the video signal; and a driving part that individually converts each of the pixel data pieces in the series of pixel data pieces into the driving voltage having a voltage value corresponding to the luminance level and supplies a plurality of driving voltages converted to the display panel.

12. The display driver according to claim 11, wherein the control unit and the temperature abnormality notification processing part are formed in a first semiconductor IC chip, and wherein the driving part and the temperature abnormality detection circuit are formed in a second semiconductor IC chip.

13. The display driver according to claim 11, wherein the control unit is formed in a first semiconductor IC chip, and wherein the driving part, the temperature abnormality notification processing part, and the temperature abnormality detection circuit are formed in a second semiconductor IC chip.

14. A display device comprising:

a display panel; and a display driver that receives a video signal and performs driving for causing the display panel to display an image based on the video signal, wherein the display driver has a temperature abnormality detection circuit that detects a temperature inside the display driver and generates a temperature abnormality detection signal indicating presence of a temperature abnormality when the temperature is higher than a predetermined temperature threshold, and a temperature abnormality notification processing part that causes the display panel to display an image for informing of occurrence of a temperature abnormality for a predetermined period instead of an image based on the video signal in accordance with the temperature abnormality detection signal.

* * * * *